US010590670B2

(12) United States Patent
Ferrari et al.

(10) Patent No.: US 10,590,670 B2
(45) Date of Patent: Mar. 17, 2020

(54) DISSIPATOR

(71) Applicants: GIRARDINI S.R.L., Tione di Trento (IT); Marco Ferrari, Trento (IT)

(72) Inventors: Marco Ferrari, Trento (IT); Silvio Antonioni, Pomarolo (IT)

(73) Assignees: Marco Ferrari, Trento (IT); GIRARDINI S.R.L., Tione di Trento (IT)

( * ) Notice: Subject to any disclaimer, the term of this patent is extended or adjusted under 35 U.S.C. 154(b) by 51 days.

(21) Appl. No.: 15/113,515

(22) PCT Filed: Jan. 22, 2015

(86) PCT No.: PCT/EP2015/051192

§ 371 (c)(1),
(2) Date: Jul. 22, 2016

(87) PCT Pub. No.: WO2015/110497

PCT Pub. Date: Jul. 30, 2015

(65) Prior Publication Data

US 2017/0007021 A1 Jan. 12, 2017

(30) Foreign Application Priority Data

Jan. 24, 2014 (IT) ..... VR2014A0015

(51) Int. Cl.
*E04H 9/02* (2006.01)
*E02D 27/34* (2006.01)
(Continued)

(52) U.S. Cl.
CPC ..... *E04H 9/023* (2013.01); *E02D 27/34* (2013.01); *E04H 9/02* (2013.01); *E04H 9/021* (2013.01); *E02D 27/01* (2013.01); *E04B 1/98* (2013.01)

(58) Field of Classification Search
CPC ..... E02D 27/34; E02D 2200/14; E02D 5/80; E02D 27/01; E04H 9/021;
(Continued)

(56) References Cited

U.S. PATENT DOCUMENTS 3,289,998 A * 12/1966 Baratoff ..... F16F 3/0873 248/568
3,606,704 A * 9/1971 Denton ..... E04F 15/024 248/619
(Continued)

FOREIGN PATENT DOCUMENTS

CN 101321921 A 12/2008
CN 203256901 U 10/2013
(Continued)

OTHER PUBLICATIONS

Chinese Office Action dated Jun. 1, 2017 from Chinese Patent Application No. 201580005012.6.
(Continued)

*Primary Examiner* — Hiwot E Tefera
*Assistant Examiner* — Taylor L Morris
(74) *Attorney, Agent, or Firm* — Scully, Scott, Murphy & Presser, P.C.

(57) ABSTRACT

A dissipator for interfacing between the ground and supporting structures, which comprises a supporting base that can be fixed to the ground and supports a contact base that can be associated, by way of kinematic connection elements, with a supporting structure, interface elements being provided between the contact base and the supporting base and being adapted to allow the movement of the contact base with respect to the supporting base at least along two directions that are parallel to the ground, control elements being further provided which act between the supporting base and the contact base and are adapted to control the
(Continued)

relative movement between the supporting base and the contact base; the dissipator comprises at least one rod-like dissipation body that acts between the ground and the supporting structure, the rod-like dissipation body having at least partially a behavior of the dissipative type.

10 Claims, 7 Drawing Sheets

(51) Int. Cl.
*E04B 1/98* (2006.01)
*E02D 27/01* (2006.01)

(58) Field of Classification Search
CPC ..... E04H 2009/026; E04H 9/02; E04H 9/023; E04H 9/027; E04H 9/022; E04H 9/00; F16F 15/04; F16F 15/06; F16F 15/02; E04B 1/98; E04B 2001/2496
USPC ..... 52/167.4, 167.8; 248/548, 562, 619, 638
See application file for complete search history.

(56) References Cited

U.S. PATENT DOCUMENTS 3,638,377 A * 2/1972 Caspe ..... E04H 9/021 52/167.4
3,794,277 A * 2/1974 Smedley ..... F16F 7/127 174/161 R
3,973,078 A * 8/1976 Wolf ..... F16F 9/19 174/42
4,107,889 A 8/1978 Gonsalves
4,200,256 A * 4/1980 Thiel ..... F16F 7/12 248/548
4,328,648 A * 5/1982 Kalpins ..... E02D 27/34 248/638
4,554,767 A * 11/1985 Ikonomou ..... E02D 27/34 52/167.9
4,565,039 A * 1/1986 Oguro ..... E02D 27/34 248/567
4,633,628 A * 1/1987 Mostaghel ..... E02D 27/34 52/167.7
4,662,142 A * 5/1987 Weiner ..... E04B 1/98 248/638
4,718,206 A * 1/1988 Fyfe ..... E04H 9/021 248/634
4,766,708 A * 8/1988 Sing ..... E04B 1/98 248/585
4,860,507 A * 8/1989 Garza-Tamez ..... E02D 27/34 248/560
4,883,250 A * 11/1989 Yano ..... E04H 9/023 248/638
4,991,366 A * 2/1991 Teramura ..... E04H 9/021 188/136
5,452,548 A * 9/1995 Kwon ..... E01D 19/041 248/567
5,558,191 A * 9/1996 Lai ..... F16F 1/387 188/379
5,630,298 A * 5/1997 Tsai ..... E04H 9/021 52/167.1
5,689,919 A * 11/1997 Yano ..... E04H 9/023 248/550
5,775,038 A * 7/1998 Sauvageot ..... E01D 19/02 14/73.5
5,797,228 A * 8/1998 Kemeny ..... E04H 9/022 248/632
5,816,559 A * 10/1998 Fujimoto ..... E04H 9/021 248/636
5,870,863 A * 2/1999 Taylor ..... E04H 9/02 248/632
5,964,066 A * 10/1999 Mori ..... E02D 27/34 52/167.1
6,042,094 A * 3/2000 Lee ..... E04H 9/021 267/150
6,085,474 A * 7/2000 Mizuno ..... E04H 9/023 52/167.1
6,115,972 A * 9/2000 Tamez ..... E02D 27/34 248/181.1
6,138,967 A * 10/2000 Okamoto ..... E04H 9/021 188/266.1
6,324,795 B1 * 12/2001 Stiles ..... E02D 27/34 52/167.4
6,438,905 B2 * 8/2002 Constantinou ..... E04H 9/02 52/1
6,837,010 B2 * 1/2005 Powell ..... E04H 9/02 403/174
7,090,207 B2 * 8/2006 Qutub ..... E04H 9/021 267/135
7,540,117 B2 * 6/2009 Yang ..... E04H 9/021 52/167.1
8,001,734 B2 * 8/2011 Pryor ..... E04B 1/2403 52/167.3
8,438,795 B2 * 5/2013 Dicleli ..... E04H 9/021 14/73.5
2004/0074723 A1 * 4/2004 Tsai ..... E04H 9/02 188/371
2005/0028457 A1 2/2005 Davis
2006/0179729 A1 * 8/2006 Li ..... E04H 9/02 52/167.7
2007/0069103 A1 * 3/2007 Ferrari ..... E04H 9/021 248/544
2013/0008102 A1 * 1/2013 Bindschedler ..... E04D 11/007 52/173.3
2014/0183802 A1 * 7/2014 Kim ..... F16F 13/007 267/140.13

FOREIGN PATENT DOCUMENTS

| | | | |
|---|---|---|---|
| EP | 1678399 | B1 | 8/2008 |
| FR | 2977902 | A1 | 1/2013 |
| JP | 60-95034 | | 5/1985 |
| JP | 1-198940 | | 8/1989 |
| JP | 2-54041 | | 2/1990 |
| JP | 2-57742 | | 2/1990 |
| JP | 2-285176 | | 11/1990 |
| JP | 11-247923 | | 9/1999 |
| JP | 11-350786 | | 12/1999 |
| JP | 2002-349091 | A | 12/2002 |
| JP | 2008-121328 | A | 5/2008 |
| JP | 2008-537698 | A | 9/2008 |
| JP | 2013-213532 | A | 10/2013 |
| WO | 2005/049942 | A1 | 6/2005 |
| WO | 2007/048836 | A1 | 5/2007 |
| WO | 2010/119154 | A1 | 10/2010 |

OTHER PUBLICATIONS

International Search Report and Written Opinion dated Mar. 12, 2015 issued in PCT/EP2015/051192.
Italian Search Report and Written Opinion dated Oct. 14, 2014 issued in IT VR20140015.
Japanese Office Action dated Jan. 8, 2019 in Japanese Application No. 2016-565560.
European Communication dated May 15, 2019 in European Application No. 15 702 993.5.
Chilean Office Action dated Nov. 9, 2018 in Chilean Patent Application No. 2016-001849.

* cited by examiner

DISSIPATOR

The present invention relates to a dissipator for interfacing between the ground and supporting structures.

In the current state of the art, in regions subject to seismic action, regulations require that buildings and structures have particular construction-related contrivances so as to avoid collapse as a result of seismic action.

However, to date, no particular attention has been given over to developing solutions and construction-related contrivances that are such as to make it possible to withstand seismic action, including for supporting structures such as shelving units and similar devices.

EP1678399 B1, in the name of Marco Ferrari, discloses a dissipator/isolator for interfacing between the ground and supporting structures, the aim of which is to prevent the collapse of structures, such as for example industrial shelving, as a result of seismic action.

Such device, interposed between the ground and the supporting structures, is capable of allowing a corresponding, and controlled, movement between the structures and the ground in every direction of the plane, so as to prevent the collapse thereof in the event of seismic action.

The device described above, while offering an effective solution to the above mentioned technical problem, by allowing the reduction of the intrinsic rigidity of the structure, does not perform particularly well when it comes to the dissipation of energy, which therefore greatly limits its field of application.

In fact, in cases where it is necessary to allow greater movements, as a result of major seismic events, the solution proposed is not capable of offering adequate levels of performance and, in the case of shelving units, even after a suitable resizing of the device of the aforementioned patent, it would greatly penalize the encumbrances, impede the full control of the movements of the supporting structure during the seismic event, and render the solution economically unviable.

Furthermore, the device described above does not make it possible to lock movements under static conditions of use, thus limiting the modes of operation and the safety conditions for certain applications, such as for example industrial shelving.

The aim of the present invention is to drastically reduce the above mentioned drawbacks, by considerably increasing the capacity for dissipation of the device and providing an effective locking element under static conditions of use.

Another object of the present invention is to prevent the tipping of the structures, so as to prevent the stored goods from being thrown and, at the same time, to prevent the collapse of supporting structures, and in particular of industrial shelving, as a result of static and seismic actions.

Another object of the present invention is to prevent the operation of the device as a result of low-level events and/or shocks, thus safeguarding the integrity of its components for events of greater intensity, such as earthquakes.

Another object of the invention is to provide a dissipator that is simple to configure, with a low production cost and a long lifetime, so as to be competitive from an economic viewpoint as well.

This aim and these and other objects which will become better apparent hereinafter are achieved by a dissipator for interfacing between the ground and supporting structures according to claim 1.

Further characteristics and advantages of the invention will become better apparent from the description of some preferred, but not exclusive, embodiments of a dissipator for interfacing between the ground and supporting structures according to the invention, which are illustrated by way of non-limiting example in the accompanying drawings wherein.

Figure 1:
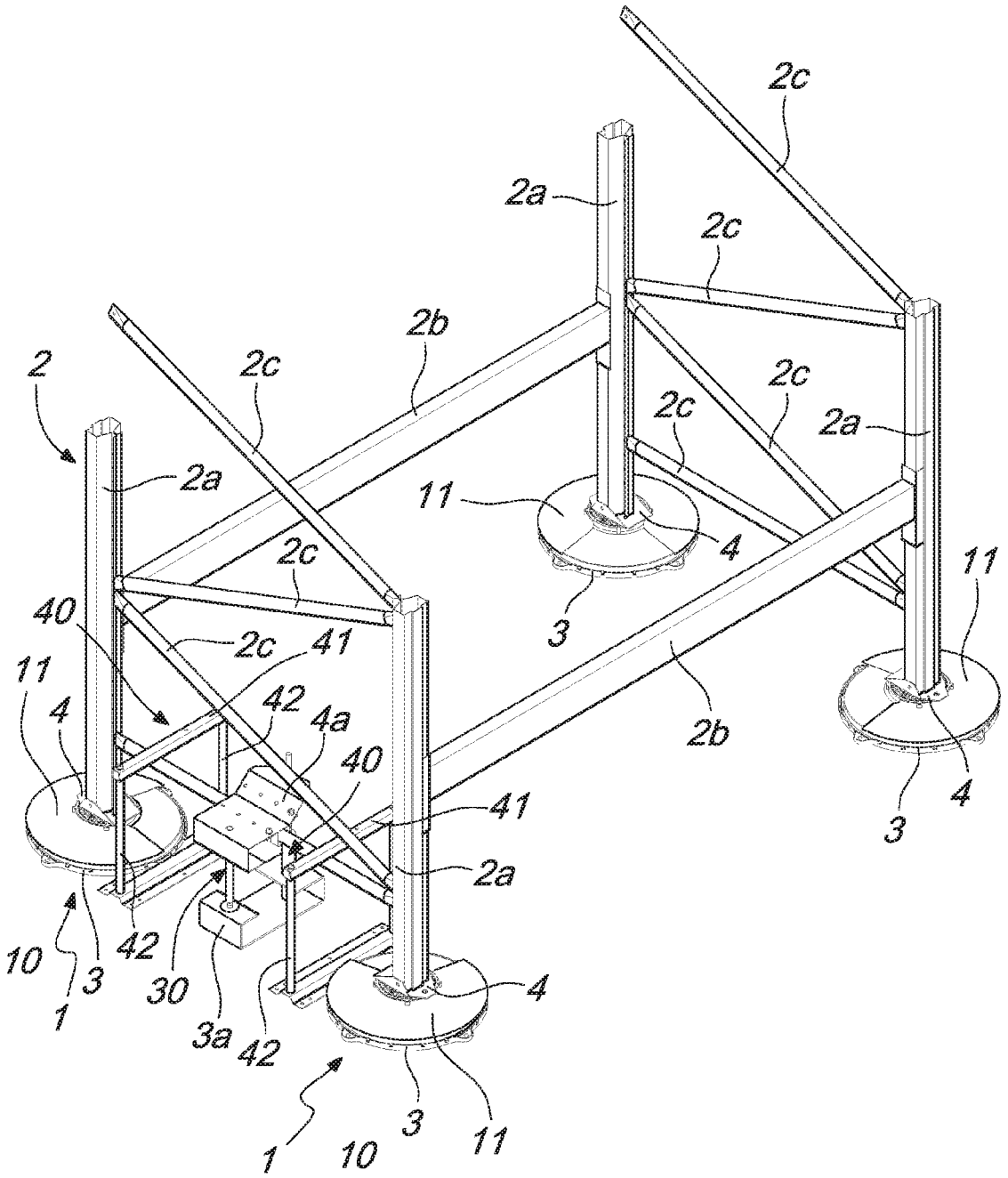
FIG. 1 is a perspective view of a shelving unit fitted with a first embodiment of a dissipator according to the invention.
Figure 2:
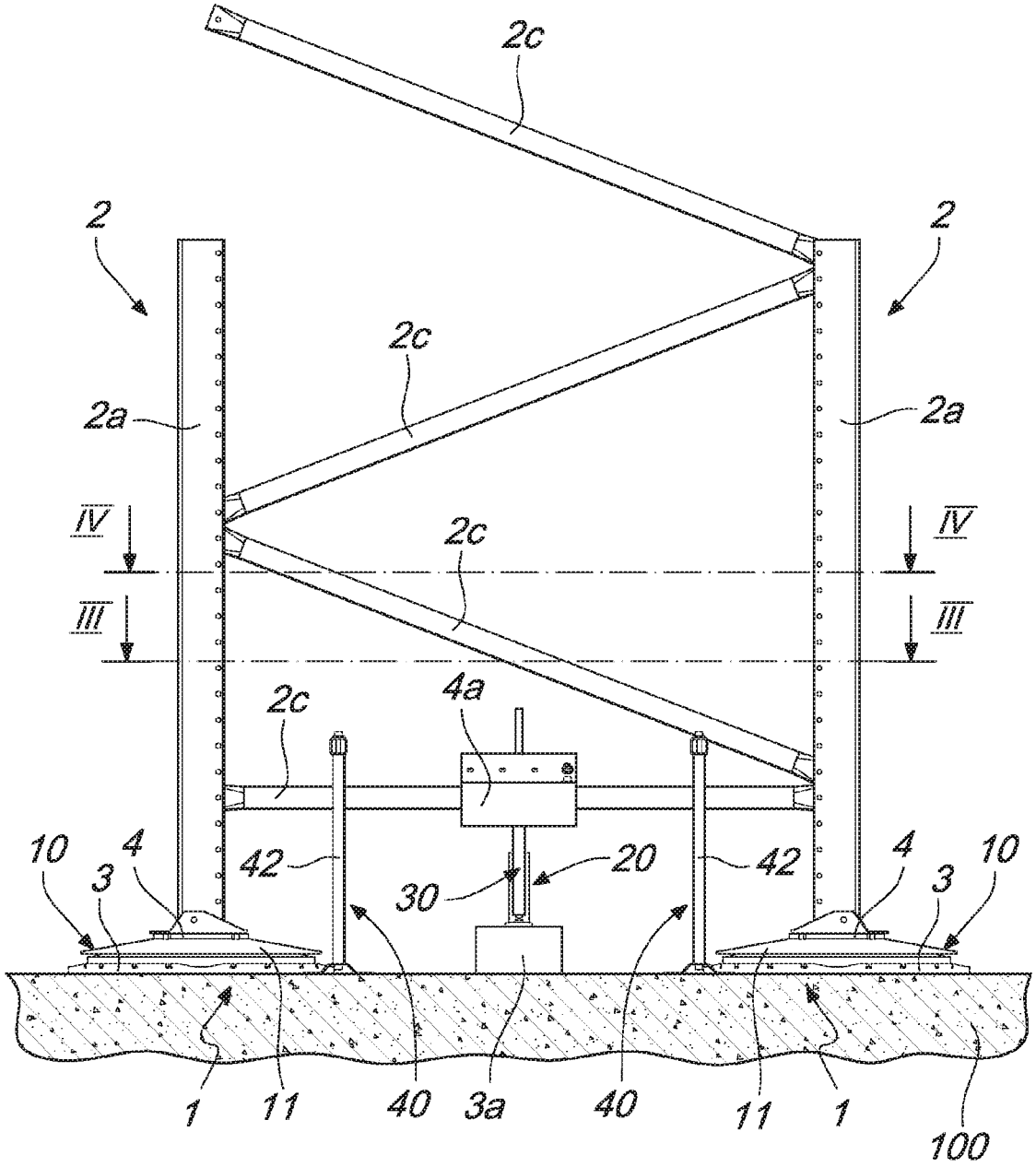
FIG. 2 is a front elevation view of the shelving unit in FIG. 1.
Figure 3:
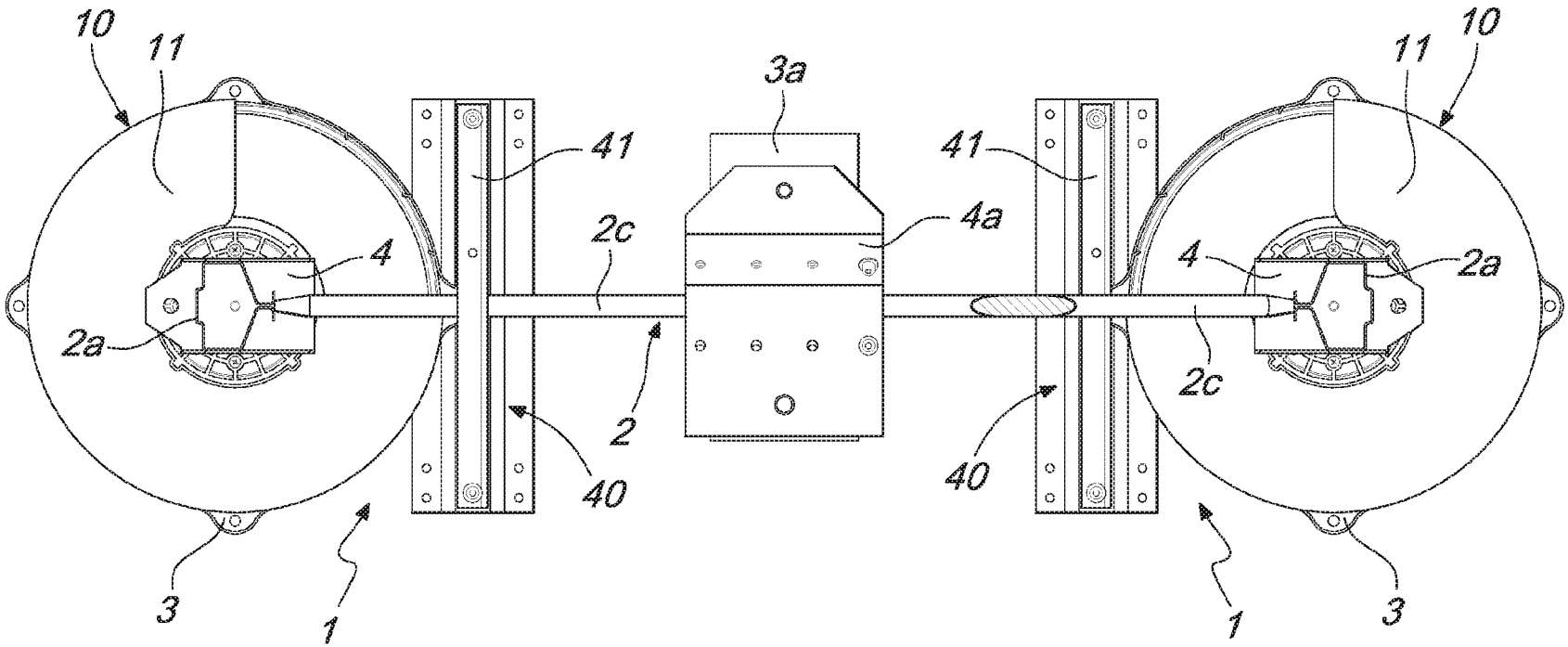
FIGS. 3 and 4 show a cross-section of the shelving unit taken along the lines marked III-III and IV-IV in FIG. 2, in which the dissipator is, respectively, in the "at rest" condition and in the "in operation" condition.
Figure 4:
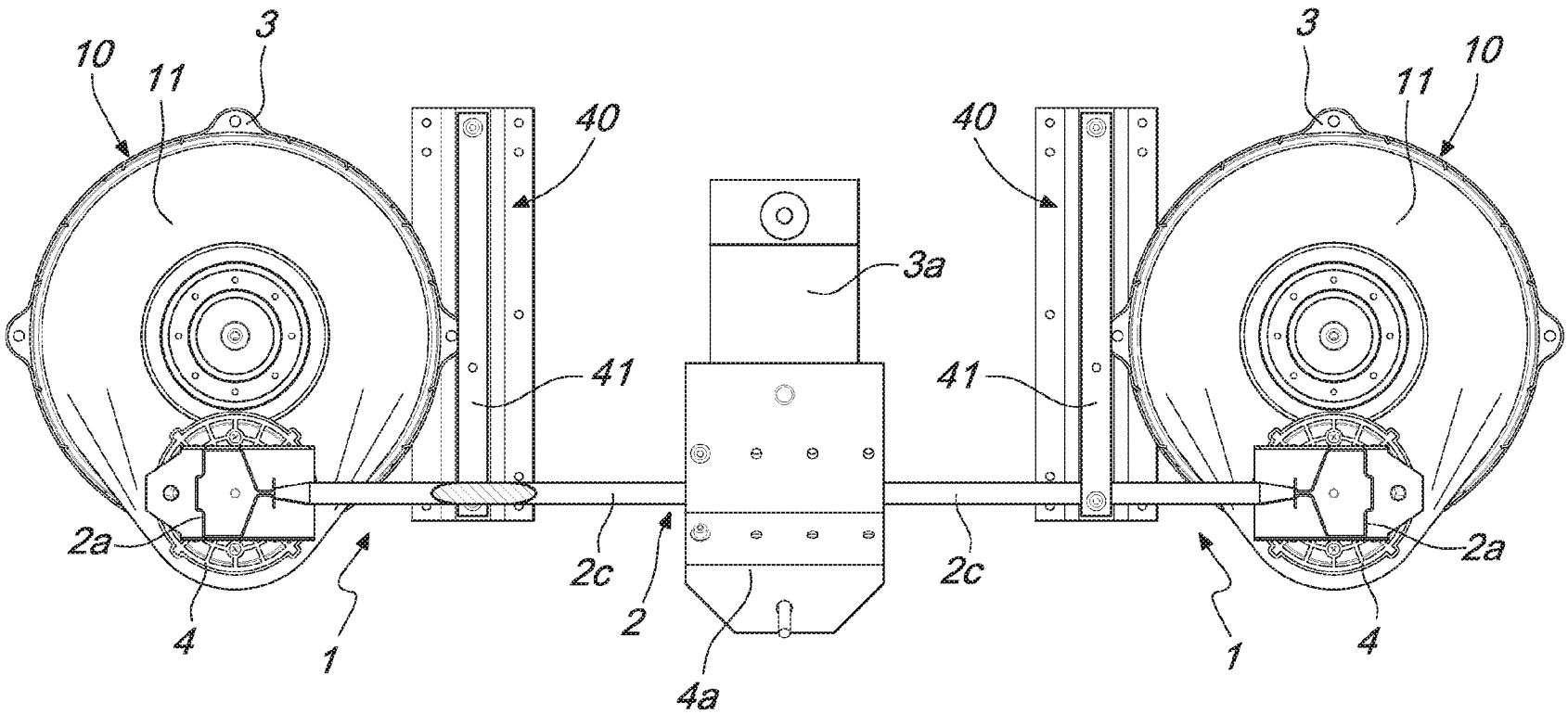

In the embodiments illustrated, individual characteristics shown in relation to specific examples may in reality be interchanged with other, different characteristics, existing in other embodiments.

The present invention relates to a dissipator, generally designated with the reference numeral 1, for interfacing between the ground 100 and supporting structures 2.

The dissipator 1 comprises at least one supporting base 3, which can be fixed to the ground 100 and supports a contact base 4.

The supporting base 3 is typically constituted by a plate element, which is intended to be fixed to the ground 100 by way of conventional fixing means, such as for example mechanical anchoring means (such as for example inserts) and/or chemical anchoring means (such as for example threaded bars with resins).

The contact base 4, which is advantageously arranged above the supporting base 3, can be associated, by way of kinematic connection means that are conventional, with a supporting structure 2.

In particular, the kinematic connection means stably associate the contact base 4 with a lower portion of a respective upright member 2*a* of a supporting structure 2, such as for example an industrial shelving unit.

More specifically, between the contact base 4 and the supporting base 3 interface means 10 are provided, which are adapted to allow the movement of the contact base 4 with respect to the supporting base 3 at least along two directions that are parallel to the ground 100.

Advantageously, the interface means 10 are adapted to allow the contact base 4 to move in all directions in the plane that is substantially parallel to the ground 100.

The dissipator 1 has, further, control means 11 which act between the supporting base 3 and the contact base 4, which are adapted to control the relative movement between the supporting base 3 and the contact base 4.

According to the present invention, the dissipator 1 comprises at least one rod-like dissipation body 20 that acts between the ground 100 and the supporting structure 2.

In particular, the rod-like dissipation body 20 has at least partially a behavior of the dissipative type.

Specifically, the rod-like dissipation body or bodies 20 makes or make it possible to dissipate the energy generated by an event, typically by an earthquake, by allowing the movement, on a plane that is parallel to the ground 100, of the supporting structures with respect to the supporting base 3.

The rod-like dissipation body 20 further makes it possible to reduce the demand in terms of movement, and the consequent optimization of the encumbrances and full control of the movements of the supporting structure during the seismic event, aspects that are particularly important for supporting structures 2 such as industrial shelving.

Advantageously, it is possible for a supporting structure 2 to be associated with a plurality of rod-like dissipation bodies 20.

In particular, respective rod-like dissipation bodies 20 can be arranged at each shoulder of the supporting structure 2.

Conveniently, the dissipator 1 has at least one device of the fuse-equipped type 30 connecting the ground 100 and the supporting structure 2.

In particular, the device of the fuse-equipped type 30 is adapted to prevent the relative movements between the contact base 4 and the supporting base 3 along the at least two directions that are parallel to the ground 100 below a preset stress threshold value that acts between the supporting base 3 and the contact base 4 on a plane that is parallel to the ground 100.

Preferably, the device of the fuse-equipped type 30 connects the contact base 4 and the respective supporting base 3.

Advantageously, the rod-like dissipation body 20 is arranged between the supporting base 3 and the respective contact base 4.

Preferably, the dissipator 1 comprises at least one base body 3*a* that can be fixed to the ground 100 and at least one abutment body 4*a* that can be fixed to the supporting structure 2.

Obviously, there is no reason why the rod-like dissipation body 20 cannot be arranged between the ground 100 and a portion of the supporting structure 2.

For the purposes of example, the rod-like dissipation body 20 can be resin-bonded in a hole made in the ground and interfaced with an abutment that is defined for example at a stringer 2*b* or the shoulder strut structure 2*c* of the supporting structure 2.

Advantageously, the device of the fuse-equipped type 30 and/or the rod-like dissipation body 20 is/are arranged between the base body 3*a* and the respective abutment body 4*a*.

With reference to the embodiment shown in FIGS. 1 to 4, it is possible for the base body 3*a* to be fixed to the ground 100 in a position spaced apart from the supporting base 3.

In this case, the abutment body 4*a* is preferably fixed to a stringer 2*b* or to the shoulder strut structure 2*c* of the supporting structure 2.

Figure 5:
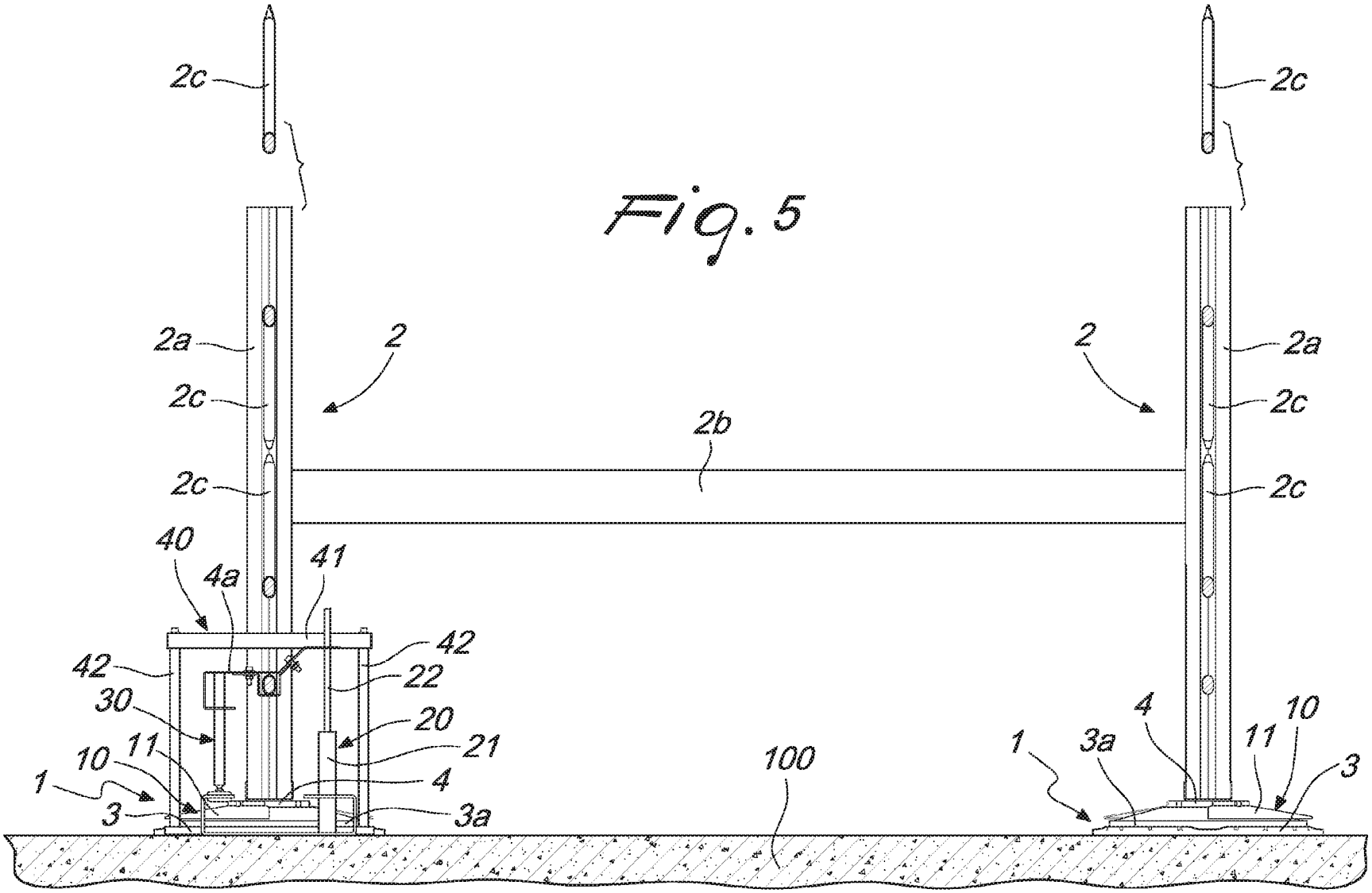
FIG. 5 is a cross-sectional view taken along a vertical plane of a shelving unit and of the dissipator according to the invention.
Figure 6:
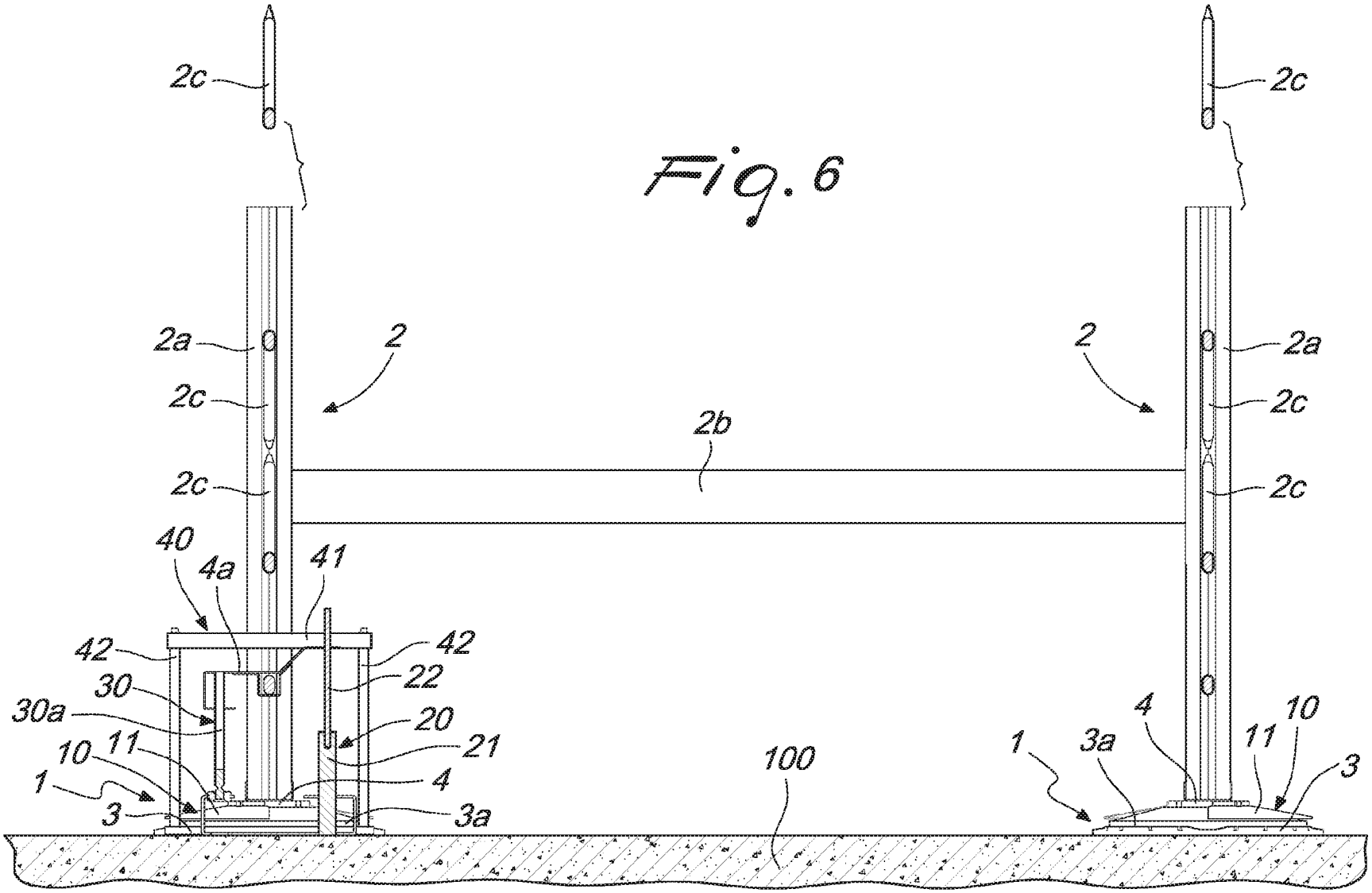
FIGS. 6 and 7 show, respectively, a cross-sectional view of the shelving unit taken along the vertical plane passing through the rod-like dissipation body, in which the dissipator is, respectively, in the "at rest" condition and in the "in operation" condition.
Figure 7:
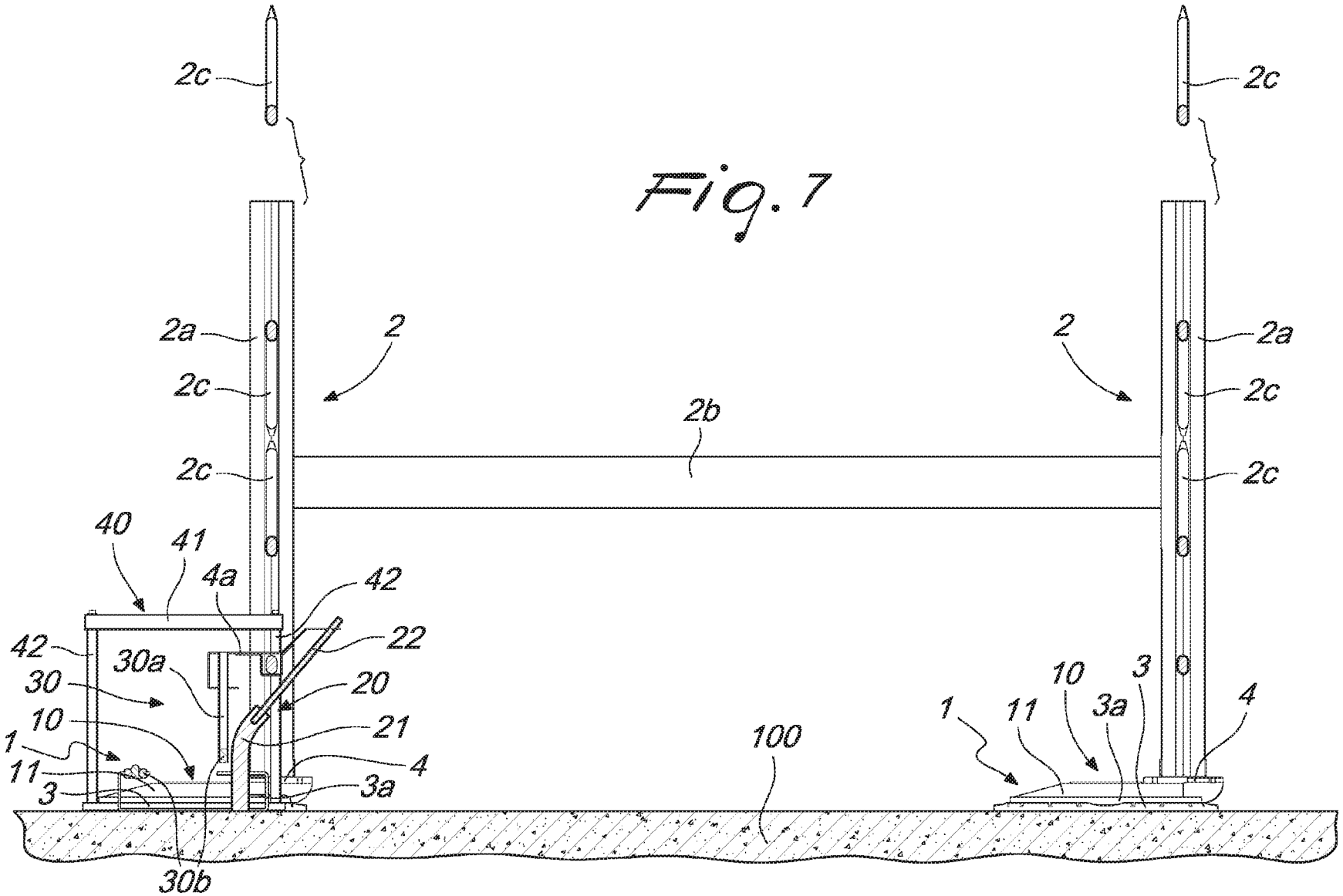

It is likewise possible, as shown in FIGS. 5 to 7, for the base body 3*a* to be fixed directly to the supporting base 3 and the abutment body 4*a* to be in turn fixed to the upright member 2*a* or to the contact base 4.

Preferably, the dissipator 1 comprises a tipping prevention device 40, which is adapted to prevent the movement of the supporting structure 2 along a direction that is perpendicular to a plane that is substantially parallel to the ground 100.

With reference to the embodiments shown in the figures, the tipping prevention device 40 can be constituted by one or more immobilizing cross-members 41, in use parallel to the ground 100, which can be fixed to at least one abutment shoulder 42 that is erected on a supporting base thereof and is arranged above an abutment element, which is for example constituted by a stringer 2*b* or by the strut structure 2*c*.

According to a preferred embodiment, the control means 11 comprise means of control of the movement of the contact base 4 with respect to the supporting base 3.

In particular, the interface means 10, which comprise the control means 11, have substantially a behavior of the elastic type, or a behavior of the viscoelastic type, or a behavior of the viscoelastoplastic type.

For the purposes of example, the control means 11 mutually connect the supporting base 3 and the contact base 4 and can be constituted by a slab of rubber or by a plurality of radially extending connection elements arranged in a radiating pattern such as, for example, springs.

The interface means 10 can comprise a plurality of balls that rest on the supporting base 3 and support the contact base 4 or a slab with a low friction coefficient made, for example, of PTFE or polyzene.

Preferably, the rod-like dissipation body 20 extends along a main direction, which is arranged substantially at right angles to the ground 100.

Advantageously, the rod-like dissipation body 20 comprises a resisting portion 22 and a dissipative portion 21.

In particular, the resisting portion 22 is connected to the supporting structure 2 while the dissipative portion 21 is connected to the ground 100.

Obviously, there is no reason why the resisting portion 22 cannot be connected to the ground 100 and the dissipative portion 21 cannot be connected to the supporting structure 2.

The rod-like dissipation body 20 can be made of a material selected from the group comprising:

lead;
lead alloy;
aluminum;
aluminum alloy;
iron;
steel;
stainless steel;
elastomer;
polymeric material;
composite metallic material;
composite polymeric material;
or combinations thereof.

Conveniently, the rod-like dissipation body 20 is substantially cylindrical so as to have an isotropic behavior.

Advantageously the rod-like dissipation body 20 has a cylindrical cross-section that is non-constant along its height so as to increase the dissipative effect.

Preferably, the rod-like dissipation body 20 is interfaced with the supporting structure 2 by way of a plate with a slot, which is adapted to allow the sliding of the end of the rod-like dissipation body 20 during the seismic event within the slot.

Conveniently, the slot is associated with a gasket and/or with an element with a low friction coefficient and/or with a ball joint.

Advantageously, the slot defines a stroke limit for the end of the rod-like dissipation body 20.

Conveniently, at one end or at both ends of the rod-like dissipator 20 there is or there are stop retainers, with or without a damping element or elements.

Advantageously, the slot/rod-like dissipator 20 coupling is provided so as to generate a further energy dissipation.

In this regard there can be, between the rod-like dissipator 20 and the respective abutment body 4*a*, at least one interposition element that is adapted to allow a further energy dissipation.

Conveniently, the transverse cross-section of the resisting portion 22 of the rod-like dissipation body 20 is circular and as small as possible compatibly with the material and with the geometry used and with the required damping characteristics: this makes it possible to reduce the play between the slot and the resisting portion 22 to the minimum.

There is no reason why the rod-like dissipation body 20 cannot be provided in a single piece.

The dissipative portion 21, which is made of metallic material, advantageously dissipates energy by elastoplastic bending.

Conveniently the dissipative portion 21 of the rod-like dissipation body 20 can be made of lead, lead alloy, aluminum, aluminum alloy, steel, stainless steel, other metallic materials, polymeric materials, rubber and composite materials or a combination thereof.

Advantageously, the resisting portion 22 of the rod-like dissipation body 20 can be constituted of other metallic materials, polymeric materials, or rubber and composite materials.

According to a possible variation of embodiment, the dissipative portion 21 of the rod-like dissipation body 20 can be connected to another portion, which is also dissipative, in lieu of the resisting portion, by way of, for example, an elastic or viscoelastic or viscoelastoplastic element.

Alternatively, the resisting portion 22 and the dissipative portion 21 of the rod-like dissipation body 20 can be made with different materials and geometric sections than those indicated above.

The device of the fuse-equipped type 30 can be provided in one piece and from a single material, metallic, polymeric or composite.

Advantageously the device of the fuse-equipped type 30 comprises a resisting part 30*a* made of a first material, for example metal, and a part intended to break 30*b* made of a second material, for example polymeric material (preferably ABS), metallic material or stone-like material.

Conveniently, the part of the device of the fuse-equipped type that is intended to break 30*b* has a different performance along a direction that is parallel to the transverse direction (cross aisle direction) and along a direction that is parallel to the longitudinal direction (down aisle direction) of the supporting structure 2.

Advantageously, the part intended to break 30*b* has a higher resistance in the cross aisle direction in order to ensure a suitable resistance during the storage operations on the supporting structures 2.

According to a preferred embodiment, the device of the fuse-equipped type 30 has the part intended to break 30*b* interfaced with the ground 100 and/or with the supporting structure 2 by way of interposition of a slotted element.

Preferably, such slotted element comprises a gasket.

Advantageously, the slotted element is defined on the base body 3*a*, or on the abutment body 4*a*, or on the stringer 2*b* and/or on the shoulder strut structure 2*c* of the supporting structure 2.

The resisting part 30*a* and the part intended to break in a controlled manner 30*b* can be made of metallic, polymeric or composite material.

Conveniently, in order to limit the effects owing to impulsive actions as a result of warehousing activities (picking), the part that breaks in a controlled manner 30*b* of the fuse pin is engaged in a hole provided with a gasket.

Alternatively, the resisting part 30*a* and the part intended to break in a controlled manner 30*b* can be made with different materials and geometric sections than those indicated above.

The device of the fuse-equipped type 30 and the tipping prevention device 40 act as immobilization means (for a preset force value) under non-seismic conditions: this ensures stability of the industrial shelving unit and correct operating modes and safety conditions during warehousing activities (picking).

The intrinsic behavior of the rod-like dissipation body 20 makes it possible to obtain, as a result of a seismic event, a significant reduction in the amplification of the movements of the supporting structure 2 on a plane that is substantially parallel to the ground 100.

In particular, its characteristic hysteretic dissipative behavior causes a continuous energy dissipation during seismic activity.

Operation of the dissipator 1 according to the present invention is evident from the foregoing description.

In particular, if the ground 100 on which the supporting structure 2 is fixed is subjected to a dynamic action (for example a seismic action), the movements of the ground 100, and thus of the supporting base 3, result in the breakage of the device of the fuse-equipped type 30, if fitted, and "activate" the interface means 10 that is entrusted with the task of isolating the supporting structure 2 from the ground 100.

During the relative movement between the contact base 4 and the supporting structure 3, the rod-like dissipation body 20 absorbs part of the energy, thus limiting the relative movements between the contact base 4 and the supporting base 3.

All the characteristics of the invention, indicated above as advantageous, convenient or similar, may also be missing or be substituted by equivalent characteristics.

The invention, thus conceived, is susceptible of numerous modifications and variations, all of which are within the scope of the appended claims.

It has further been found that a dissipator according to the present invention can also be used in different fields of application, such as, for example, in the seismic protection of systems and components for the construction industry, buildings, artworks, cultural assets and other structures.

In practice the materials employed, provided they are compatible with the specific use, and the dimensions and shapes, may be any according to requirements.

Moreover, all the details may be substituted by other, technically equivalent elements.

The disclosures in Italian Patent Application No. VR2014A000015 from which this application claims priority are incorporated herein by reference.

The invention claimed is:

1. A dissipator which comprises:

a contact base configured to rest on a supporting base, the supporting base can be fixed to a ground surface and supports the contact base, wherein the contact base is connected to a supporting structure by a flange, a coupling being provided between said contact base and said supporting base and being adapted to allow the movement of said contact base with respect to said supporting base at least along two directions that are parallel to the ground surface, wherein said coupling is adapted to allow the movement of said supporting structure on a plane that is substantially parallel to the ground surface, wherein said coupling further comprises an elastic element which acts between said supporting base and said contact base and is adapted to control the relative movement between said supporting base and said contact base, at least one dissipation body that acts between the ground surface and said supporting structure, said at least one dissipation body having at least partially a dissipative property, wherein said dissipation body has an elongated shape that has a circular transverse cross-section that is variable along a length of the dissipation body, so as to have an isotropic behavior, wherein said dissipation body extends along a main direction that is arranged substantially at right angles to the ground surface, wherein said dissipation body comprises a resisting portion and a dissipative portion, and wherein said resisting portion is connected to said supporting structure and said dissipative portion is connected to the ground surface, wherein said dissipation body is interfaced with the supporting structure by way of a plate, at least one device of the fuse-equipped type that connects the ground surface and the supporting structure, said device of the fuse-equipped type being adapted to prevent the relative movements between said contact base and said supporting base along said at least two directions that are parallel to the ground surface below a preset stress threshold value that acts between said supporting base and said contact base on the plane that is parallel to the ground surface, at least one base body that can be fixed to the ground surface and at least one abutment body that can be fixed to said supporting structure, said device of the fuse-equipped type and/or said dissipation body being arranged between said base body and the abutment body, at least one tipping prevention device that is adapted to prevent the movement of said supporting structure along a direction that is perpendicular to a plane that is substantially parallel to the ground surface, and the plate connected to the supporting structure, wherein the resisting portion extends through a slot in the plate.

2. The dissipator according to claim 1, wherein said coupling is configured to control the movement of said contact base with respect to said supporting base, said coupling having substantially a behavior of the elastic type, or a behavior of the viscoelastic type or a behavior of the viscoelastoplastic type or of the plastic type, or of the viscous type, or of the elastoplastic type.

3. The dissipator according to claim 1, wherein said dissipation body is made of a material selected from the group that comprises:

lead;
lead alloy;
aluminum;
aluminum alloy;
iron;
steel;
stainless steel;
elastomer;
polymeric material;
composite metallic material;
composite polymeric material;
or combinations thereof.

4. The dissipator according to claim 1, further comprising, between said dissipation body and the abutment body, at least one interposition element that is adapted to allow a further energy dissipation.

5. The dissipator according to claim 1, wherein at least at one end of the dissipation body there is a stop retainer.

6. The dissipator according to claim 1, wherein said device of the fuse-equipped type is made at least partially of a material selected from the group consisting of a polymeric material, an Acrylonitrile Butadiene Styrene (ABS), a metallic material, and a stone material.

7. The dissipator according to claim 1, wherein said device of the fuse-equipped type comprises a resisting part made of a first material and a part intended to break made of a second material.

8. The dissipator according to claim 7, wherein said part intended to break has a greater resistance in a direction that is parallel to a transverse direction, said transverse direction being a cross-aisle direction, than a resistance in a direction that is parallel in a longitudinal direction, said longitudinal direction being a down-aisle direction, in order to ensure an appropriate resistance during storage operations on the supporting structure.

9. The dissipator according to claim 7, wherein said device of the fuse-equipped type has said part intended to break interfaced with the ground surface.

10. The dissipator according to claim 1, wherein an interface is between the contact base and the supporting base, the interface configured to allow the contact base to move in all directions in a plane that is parallel to the ground surface.

* * * * *